US007179090B1

(12) United States Patent
Lynch et al.

(10) Patent No.: US 7,179,090 B1
(45) Date of Patent: Feb. 20, 2007

(54) INTEGRAL DUAL-COMPONENT CURRENT COLLECTION DEVICE

(75) Inventors: William A. Lynch, Philadelphia, PA (US); Neal A. Sondergaard, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/311,576

(22) Filed: Dec. 8, 2005

(51) Int. Cl.
*H01R 39/00* (2006.01)

(52) U.S. Cl. ..... 439/13; 310/239; 310/242; 310/245; 310/247

(58) Field of Classification Search ..... 439/13, 439/29, 66; 310/239, 242, 245, 247
See application file for complete search history.

(56) References Cited

U.S. PATENT DOCUMENTS

| | | | | |
|---|---|---|---|---|
| 1,253,265 | A | 1/1918 | McKeown | |
| 1,668,381 | A | 5/1928 | Schild | |
| 4,246,508 | A | 1/1981 | Zimmer | |
| 4,277,708 | A | 7/1981 | McNab et al. | |
| 4,297,605 | A | 10/1981 | Tak | |
| 4,314,171 | A | 2/1982 | Hatch | |
| 4,358,699 | A | 11/1982 | Wilsdorf | |
| 4,415,635 | A | 11/1983 | Wilsdorf | |
| 4,513,495 | A | 4/1985 | Kimberlin | |
| 4,544,874 | A | 10/1985 | Weldon et al. | |
| 4,553,057 | A | 11/1985 | Saeed | |
| 4,607,184 | A | 8/1986 | Takahashi et al. | |
| 4,625,136 | A | 11/1986 | Kipke | |
| 5,723,932 | A | 3/1998 | Ito et al. | |
| 5,957,703 | A * | 9/1999 | Arai et al. | 439/66 |
| 6,073,439 | A * | 6/2000 | Beaven et al. | 60/223 |
| 6,131,364 | A * | 10/2000 | Peterson | 52/786.13 |
| 6,274,216 | B1 * | 8/2001 | Gonidec et al. | 428/116 |

(Continued)

OTHER PUBLICATIONS

U.S. Appl. No. 11/250,698, filed Oct. 8, 2005, entitled "Ion Conducting Electrolyte Brush Additives," joint inventors William et al.

(Continued)

*Primary Examiner*—Tho D. Ta
(74) *Attorney, Agent, or Firm*—Howard Kaiser

(57) ABSTRACT

A dual-nature, uni-constructed device, suitable for conducting electricity between two objects in relative motion, comprises two compatible elements each having a straight section and a sinuous section. The two elements are combined to form a unified whole whereby the two straight sections are mutually servable as a brush component and the two sinuous sections are mutually servable as a spring component. The inventive device is associable with an electrical or electromechanical machine so that, during machine operation, the brush component slidingly contacts a first machine part, the spring component is affixed to a second machine part and exerts a bias against the brush component, and the inventive device conducts electrical current from one machine part to the other machine part. Each element includes an electrically conductive main layer (including one or more wire fabric sheets) and two elastomeric outside layers (on opposite sides of the sinuous section).

20 Claims, 10 Drawing Sheets

U.S. PATENT DOCUMENTS

| | | | | |
|---|---|---|---|---|
| 6,404,094 | B1 | 6/2002 | Drexlmaier et al. | |
| 6,628,036 | B1 * | 9/2003 | Lynch et al. | 310/242 |
| 6,752,634 | B2 * | 6/2004 | Gonzalez et al. | 439/66 |
| 6,873,078 | B1 | 3/2005 | Piec et al. | |
| 6,991,468 | B1 | 1/2006 | Lynch et al. | |
| 7,026,738 | B1 | 4/2006 | Lynch et al. | |
| 7,138,743 | B1 | 11/2006 | Sondergaard et al. | |

OTHER PUBLICATIONS

U.S. Appl. No. 10/863,844, filed Jun. 3, 2004, entitled "Electrical Current Transferring and Brush Pressure Exerting Interlocking Slip Ring Assembly," joint inventors William et al.

* cited by examiner

FIG. 8
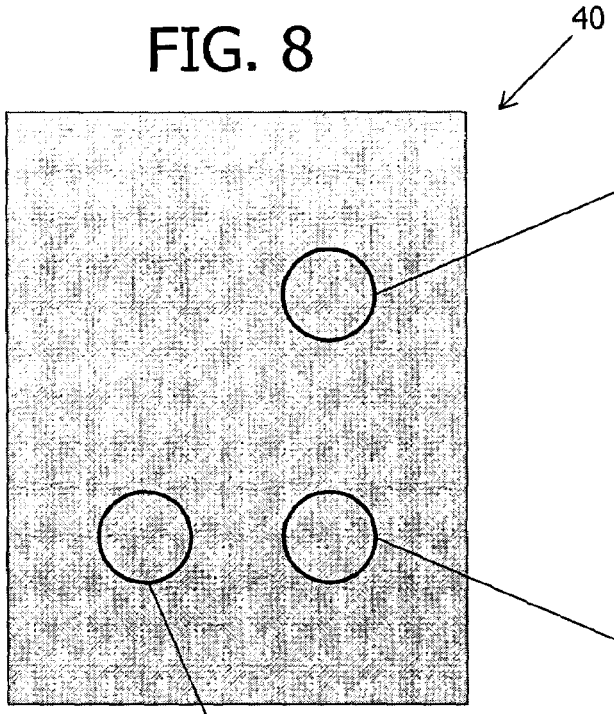
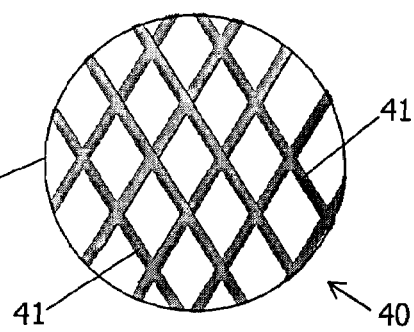
FIG. 9
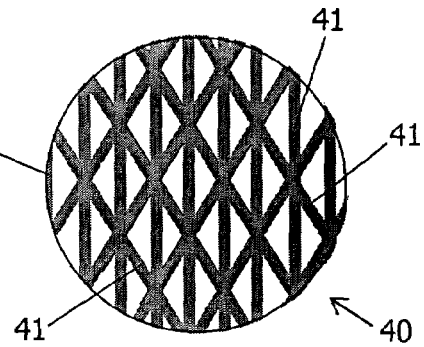
FIG. 10
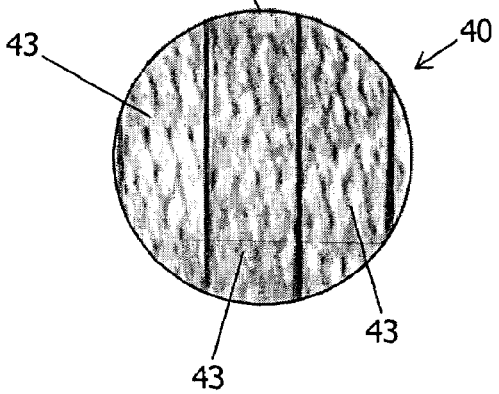
FIG. 11
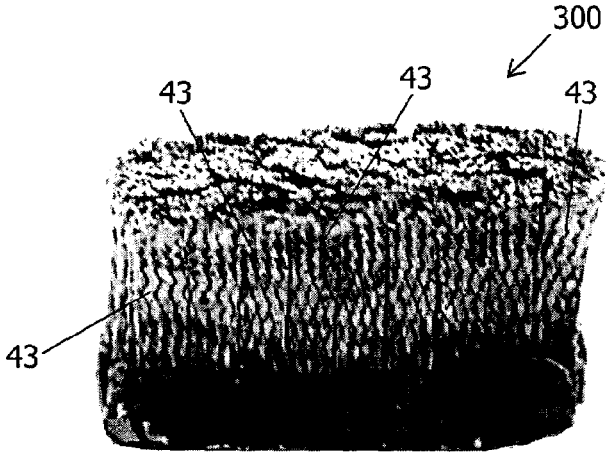
FIG. 16

INTEGRAL DUAL-COMPONENT CURRENT COLLECTION DEVICE

CROSS-REFERENCE TO RELATED APPLICATIONS

This application is related to U.S. nonprovisional application Ser. No. 10/863,844, filed 3 Jun. 2004, hereby incorporated herein by reference, entitled "Electrical Current Transferring and Brush Pressure Exerting Interlocking Slip Ring Assembly," joint inventors William A. Lynch, Wayne Marks, Jr. and Neal A. Sondergaard.

This application is related to U.S. nonprovisional application Ser. No. 10/985,074, filed 5 Nov. 2004, hereby incorporated herein by reference, entitled "Solid and Liquid Hybrid Current Transferring Brush," joint inventors Neal A. Sondergaard and William A. Lynch.

This application is related to U.S. nonprovisional application Ser. No. 10/985,075, filed 5 Nov. 2004, hereby incorporated herein by reference, entitled "Folded Foil and Metal Fiber Braid Electrical Current Collector Brush," joint inventors William A. Lynch, Neal A. Sondergaard and Wayne Marks, Jr.

This application is related to U.S. nonprovisional application Ser. No. 11/033,619, filed 13 Jan. 2005, hereby incorporated herein by reference, entitled "Quad Shaft Contrarotating Homopolar Motor," joint inventors William A. Lynch and Neal A. Sondergaard.

This application is related to U.S. nonprovisional application Ser. No. 11/250,698, filed 8 Oct. 2005, hereby incorporated herein by reference, entitled "Ion Conducting Electrolyte Brush Additives," joint inventors William A. Lynch and Neal A. Sondergaard.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to machinery involving the conduction of electrical current between parts moving relative to each other, more particularly to methods and devices for effecting or facilitating such electrical conduction.

Various kinds of motors, generators and other electrical apparatus require the conduction of electricity between two relatively moving parts. Such mechanical arrangements usually involve the conduction of current between a stationary part (stator) and a rotating part (rotor). A device known as a "brush" or "current collector" is normally used for making sliding contact between stationary and rotating parts so as to conduct electrical current therebetween.

Depending on the particular machinery, a brush can be used to conduct current in either direction (i.e., either from the stationary part to the rotating part, or vice versa), and can be fixed with respect to either the rotating part or the stationary part. Among the desirable qualities of a brush are high current-carrying capacity (e.g., in terms of capability of carrying a high amount of current per unit area of the interface between the brush and the surface contacted thereby), low friction, and high wear resistance. Current collection brush technology has grown in interest with the advent and continued development of homopolar machine technology, particularly in the realm of homopolar motors (which operate on direct current) such as those that are currently envisioned for naval ship propulsion.

Conventional brushes include solid carbon brushes, copper fiber brushes and liquid metal brushes. The majority of brushes currently used are of the solid carbon variety. Solid carbon brushes provide limited power densities due to their characteristically small number of contact spots. In addition, solid carbon brushes tend to have a short life and to produce conductive wear debris, resulting in frequent brush replacement and frequent machinery cleaning and associated high maintenance costs. Generally speaking, as compared with solid carbon brushes, copper fiber brushes are considered to afford superior performance; however, copper fiber brushes are currently expensive to produce and can support only moderate current densities. It is generally believed that liquid metal brushes are capable of supporting very high current densities, but more research is needed in this area because of problems concerning stability and reactivity.

A conventional current collection assembly includes a brush and a "holder" (for the brush) as two separate components that are attached to each other. The holder is also attached to either the stationary part or the rotating part of the machinery. Soldering is normally implemented to achieve attachment between a brush and a holder. Small voltage drops are associated with solder joints, which can thus adversely affect performance. Moreover, solder joints are prone to mechanical failure.

SUMMARY OF THE INVENTION

In view of the foregoing, it is an object of the present invention to provide an improved current collection device.

As typically embodied, the present invention's device comprises two congruous elements, equal in length, each element having two ends. Each element includes a longitudinally straight section (which extends from the first end) and a longitudinally sinuous section (which extends from the second end). The elements are contrapositionally coupled so that: The straight sections (which are equal in length) adjoin; the first ends are even; the second ends adjoin; and, the sinuous sections (which are equal in length) are oppositely undulate. Each element includes an electrically conductive wire fabric (or a group of adjoining electrically conductive wire fabrics) and an elastomeric coating. According to typical inventive practice, each electrically conductive wire fabric is made of a suitable metal elemental material (such as copper, silver, or gold or another metal) or a suitable metal alloy material (such as including copper, silver, and/or gold and/or another metal). In each element: The electrically conductive wire fabric extends from the first end to the second end; the elastomeric material covers a portion of the outside surfaces (including both the inward facing and outward facing surfaces) of the electrically conductive wire fabric (or the group of adjoining electrically conductive wire fabrics), the elastomeric coating being predominately in the sinuous section; a solder material infuses a portion of the electrically conductive wire fabric (or the group of adjoining electrically conductive wire fabrics), the solder material-infused portion being in the sinuous section in the vicinity of the second end. The lower outside surface of the solder-infused portion is not covered by the elastomeric material, but instead is contactingly covered by an electrically conductive (e.g., metal) plate that facilitates electrical conductivity.

According to typical practice of the present invention, the two solder-infused portions of the respective sinuous sections of the two elements adjoin each other (e.g., are connected to or proximate to each other) so as to together form a solder-based electrical contact, which according to typical embodiments includes electrically conductive plating that covers the bottom surface of the two adjoining solder-infused portions. Further according to typical inventive practice, in each element a cement material infuses a portion of the electrically conductive wire fabric (or the group of adjoining electrically conductive wire fabrics), the cement-infused portion being in the sinuous section adjacent to the solder-infused portion. The two respective cement-infused portions thus barricade the solder-based electrical contact (which is formed by the two respective solder material-infused portions) so as to prevent infiltration of the solder material into other portions of the respective elements. The inventive device is securable at the solder-based electrical contact with respect to machinery so that: The straight sections together constitute a brush for contacting (at the first ends) a machinery part that moves relative to the inventive device; the electrically conductive plate that contiguously covers the solder-based electrical contact is in abutting physical contact with another machinery part, viz., a machinery part that is fixed with respect to the inventive device; and, the sinuous sections together constitute a spring for biasing the straight sections toward the contacted relatively moving machinery part.

The spring-like nature of the sinuous sections is associated with a reduction in the length of the elements (and hence of the inventive device) when the inventive device is secured at the solder-based electrical contact with respect to the machinery. According to many of the present invention's current collection applications, the two relatively moving machinery parts are a stationary part and a moving (e.g., rotating) machinery part; depending on the inventive embodiment, the contacted machinery part is either a stationary part or a moving (e.g., rotating) machinery part. The inventive device is securable at the solder-based electrical contact with respect to either a stationary machinery part (if the contacted machinery part is a moving part) or a moving machinery part (if the contacted machinery part is a stationary part) so that the elements together constitute an electrical conductor between the stationary machinery part and the moving machinery part. In accordance with some embodiments of the present invention, the two relatively moving machine parts are both moving (e.g., rotating) parts; for instance, the present invention can be practiced in association with contra-rotating machines in which both relatively moving parts rotate. The electrically conductive (e.g., gold, silver or other metal) plate (e.g., plating such as electroplating), which is attached to the solder-infused metal fabric and thereby made part of the solder-based electrical contact, serves to facilitate electrical conduction between the inventive device and the machine part with respect to which the inventive device is secured.

The present invention's device is normally practiced as a current collection device that serves as an electrically conductive bridge or conduit between two bodies in motion relative to each other, the inventive device effecting fixed electrical connection with respect to one of the bodies and effecting sliding electrical connection with respect to the other of the two bodies. The inventive current collection device represents a unitary combination that includes, in purpose and effect, both a brush and a bias-producing holder-analogue for the brush. The present invention is thus typically embodied as a combined, one-piece current collector that represents a kind of integrated "brush-plus-holder" device. The "spring" component of the inventive device is analogous to the holder of a conventional current collection assembly that includes a brush and a holder as two discrete parts, the holder being attached to an object as well as to the brush (thereby holding the brush in place). The inventive device's "brush" component represents a structurally continuous extension of the inventive device's spring component.

The inventive current collection device lacks a mechanical joint of any kind (e.g., a solder joint) for joining the inventive brush component with the inventive spring component, since they are intrinsically joined together as one. According to many inventive embodiments, no mechanical joint (e.g., solder joint) is required in the fabrication process of an inventive device. The inventive brush component and the inventive spring component are structurally continuous parts of the inventive unitary construction. Because of the present invention's obviation of attachment (e.g., solder-type attachment) between the present invention's brush component and the present invention's "spring" component, the present invention affords greater mechanical stability as well as greater electrical stability. The inventive device is less prone to mechanical failure associated with the utilization of one or more solder joints amidst a conventional current collection assembly. Furthermore, because of the relatively low mass of the inventive device as typically embodied, the inventive device is less prone to voltage fluctuation than is a conventional, more massive, brush-holder device.

The present invention can be used in practically any application involving relatively moving parts of a machine (e.g., an electrical machine or an electromechanical machine), including but not limited to applications involving motors (e.g., homopolar motors), generators (e.g., homopolar generators), commutators, etc. A typical brush component in accordance with the present invention is narrowly proportioned and thus, advantageously, may be characterized by low losses of magnetic circulating currents. Because the electrically conductive fibrous elements of a typical inventive device are less independent than are the electrically conductive fibrous elements in a conventional fiber brush, higher losses of electrical conduction (both in the electrically conductive elements and in the interface at which the brush makes sliding, frictional contact with a relatively moving object) may be associated with some embodiments of inventive practice than may be associated with some embodiments of conventional practice.

Other objects, advantages and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein:

FIG. 8 is a plan view of a planar (unbent) rectangular piece of electrically conductive wire fabric suitable for inventive practice.

FIG. 9, FIG. 10 and FIG. 11 are each a partial and enlarged view of the wire fabric shown in FIG. 5. FIG. 9 depicts a biaxially braided wire fabric construction. FIG. 10 depicts a triaxially braided wire fabric construction. FIG. 11 depicts a wire fabric construction of plural (e.g., multiple) parallel bonded elongate members, each elongate member representing a braid-like grouping of plural individual wire strands, fibers or filaments.

FIG. 16 is a perspective view (by way of photographic image) of an embodiment of a braid brush in accordance with the present invention.

DETAILED DESCRIPTION OF THE INVENTION

Figure 1:
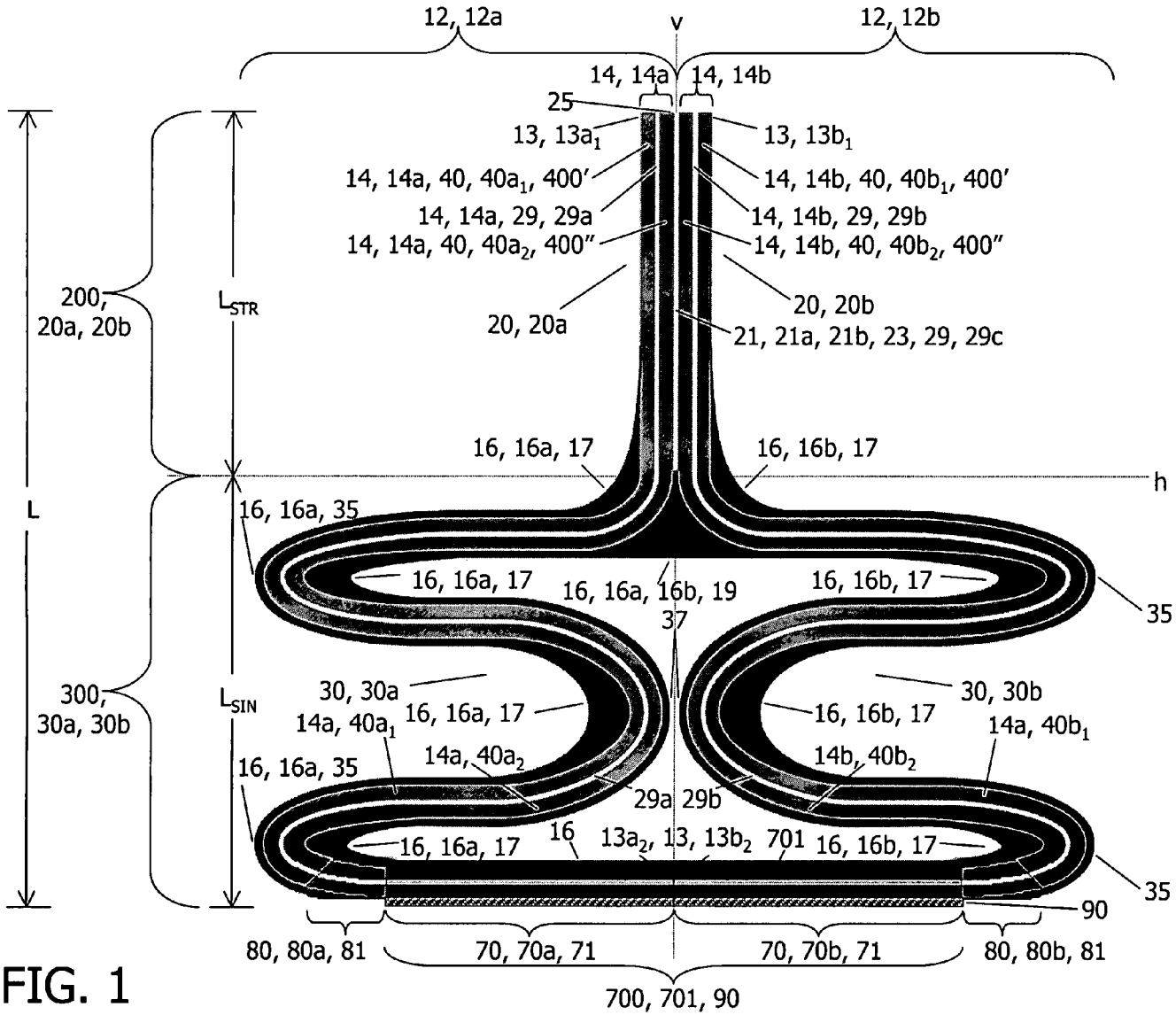
FIG. 1 is a longitudinally sectional front elevation view of a typical embodiment of an integral current collection device in accordance with the present invention, particularly illustrating the partially linear, partially curvilinear configuration of the inventive device.
Figure 2:
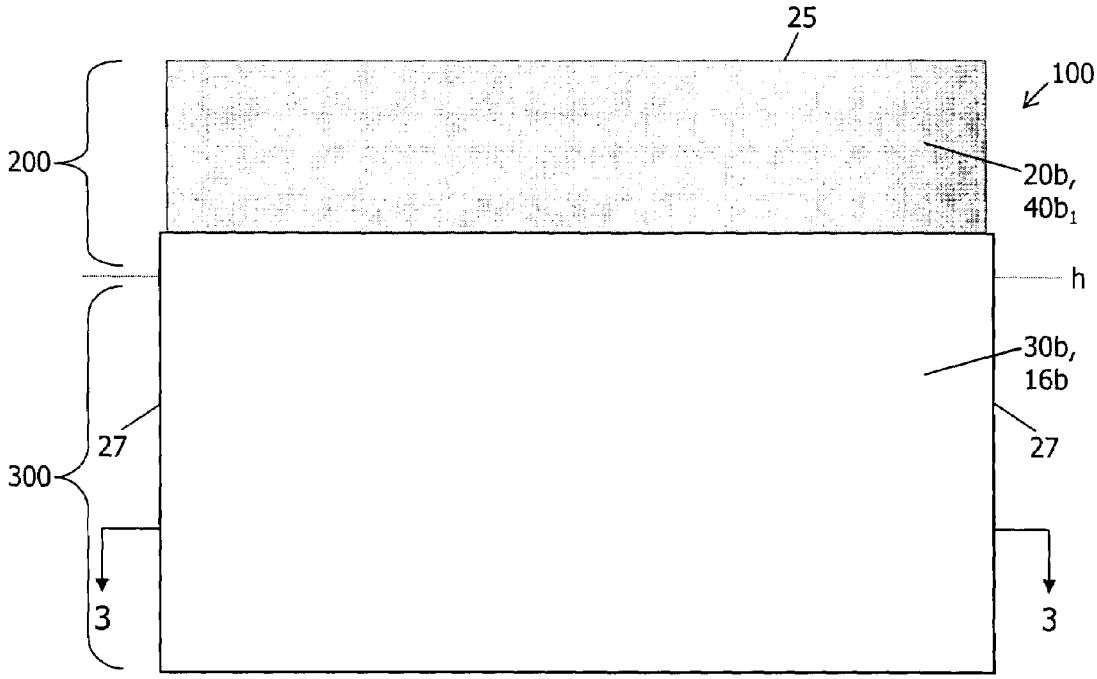
FIG. 2 is a side elevation view of the inventive device shown in FIG. 1.
Figure 3:
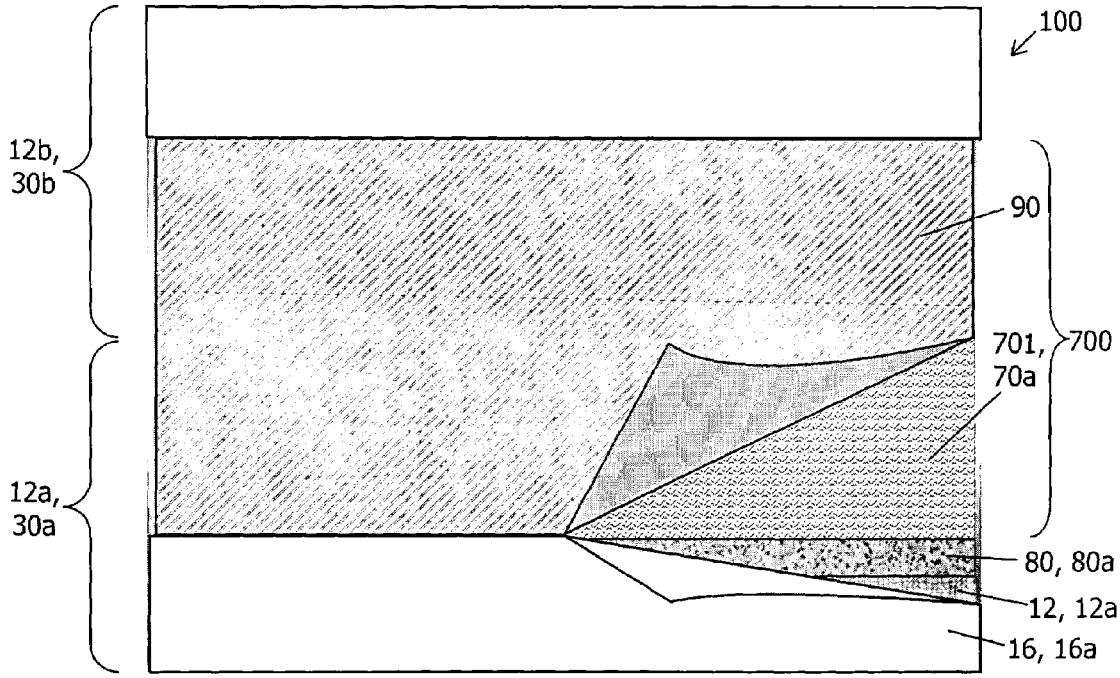
FIG. 3 is a bottom plan view, oriented sideways, of the inventive device shown in FIG. 1, with certain exterior layer portions peeled back to reveal corresponding interior layer portions.
Figure 4:
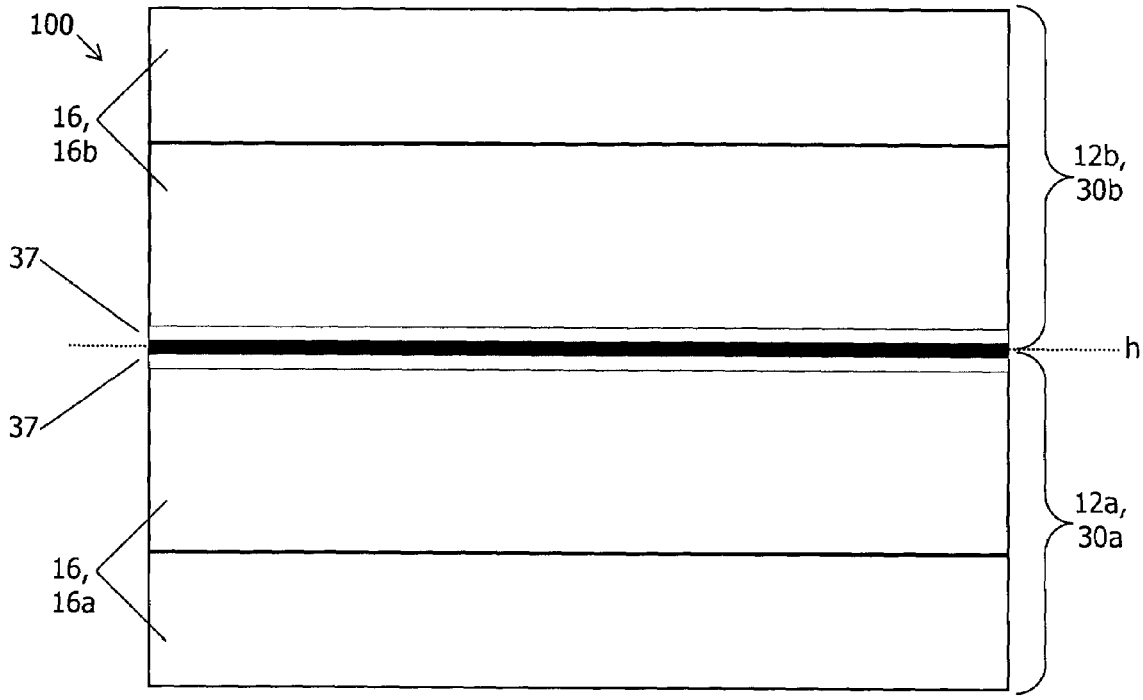
FIG. 4 is a partial version of the bottom plan view shown in FIG. 3 of the inventive device shown in FIG. 1, the solder-infused contact section being removed so as to reveal inward facing surfaces of the inventive device.

Reference is now made to FIG. 1 through FIG. 5, which show a typical embodiment of an integral, dual-component, current collection device 100 in accordance with the present invention. The present invention's current collection device 100 includes two partially linear, partially sinuous elements representing equal and opposite halves of inventive device 100, viz., an element 12*a* (on the lefthand side as shown in FIG. 1) and an element 12*b* (on the righthand side as shown in FIG. 1). Imaginary vertical geometric plane v bisects inventive device 100 into element 12*a* and element 12*b*, which are congruous and oppose each other so as to represent mirror images of each other when viewed as depicted in FIG. 1. Inventive device 100 is thus characterized by a left-right symmetry, as illustrated in FIG. 1, that is exhibited in complementary fashion by elements 12*a* and 12*b* with respect to vertical geometric plane v.

Each element 12 is characterized by the same overall vertical length L and two ends 13. End $\mathbf{13}a_1$ is the upper end of element 12*a*; end $\mathbf{13}a_2$ is the lower end of element 12*a*; end $\mathbf{13}b_1$ is the upper end of element 12*b*; end $\mathbf{13}b_2$ is the lower end of element 12*b*. Each element 12 includes a straight section 20 and a sinuous section 30. In each element 12, the overall vertical length L equals the sum of the straight section 20's vertical length $L_{STR}$ plus the sinuous section 30's vertical length $L_{SIN}$. Not only overall length L, but also straight section length $L_{STR}$ and sinuous section length $L_{SIN}$, are the same in each element 12. Vertical length L effectively represents the axial length, taken along vertical plane v, of inventive device 100. Straight section 20*a* is longitudinally delimited by upper end $\mathbf{13}a_1$ and horizontal geometric plane h. Straight section 20*b* is longitudinally delimited by upper end 13*b*, and horizontal geometric plane h. Sinuous section 30*a* is longitudinally delimited by lower end $\mathbf{13}a_2$ and horizontal geometric plane h. Sinuous section 30*b* is longitudinally delimited by lower end $\mathbf{13}b_2$ and horizontal geometric plane h. Sinuous sections 30*a* and 30*b* are largely separated from each other, but converge at lower ends $\mathbf{13}a_2$ and $\mathbf{13}b_2$ as well as in the vicinity of horizontal geometric plane h, which is shown in FIG. 1 to approximately intersect the bottom end of junction 23. Lower ends $\mathbf{13}a_2$ and $\mathbf{13}b_2$ meet at vertical geometric plane v, and junction 23 coincides with vertical geometric plane v.

Figure 5:
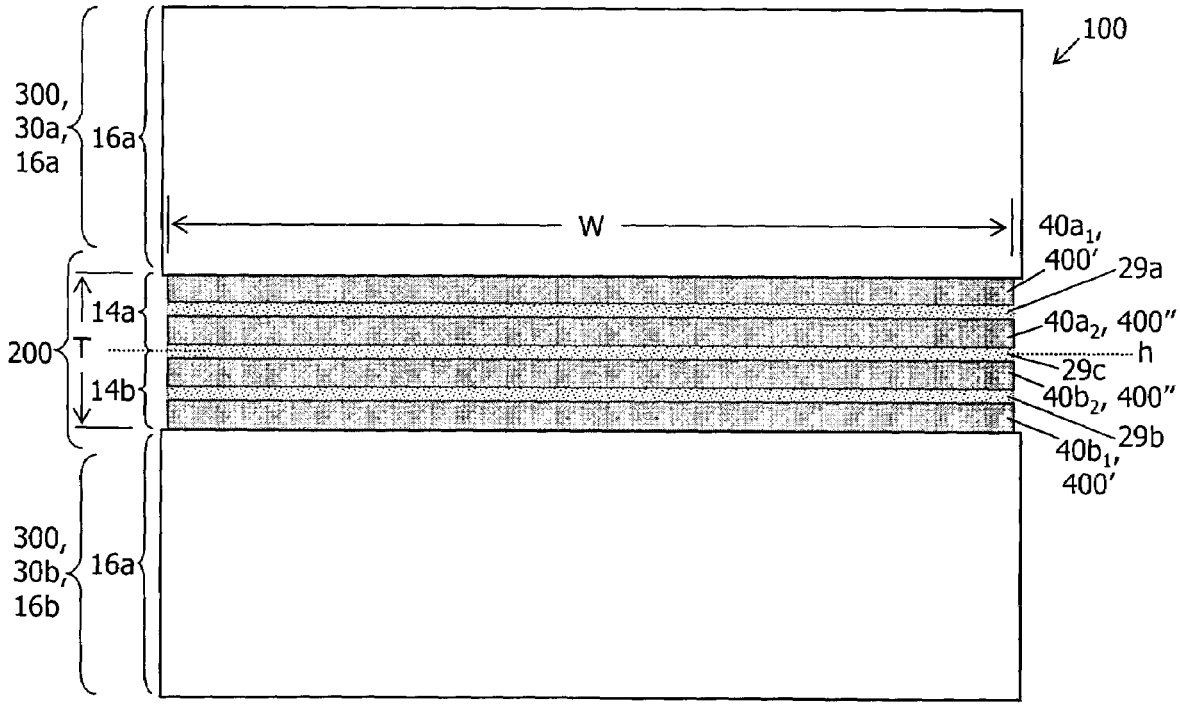
FIG. 5 is a top plan view, oriented sideways, of the inventive device shown in FIG. 1.

Each straight section 20 includes a flat or substantially flat surface 21. The straight sections 20*a* (of element 12*a*) and 20*b* (of element 12*b*) adjoin each other, surface 21*a* (of the core 14*a* portion of straight section 20*a*) to surface 21*b* (of the core 14*b* portion of straight section 20*b*), so as to form a junction 23. According to typical inventive practice, surfaces 21*a* and 21*b* are adhered to each other at junction 23 via a cement or other adhesive material 29, such as shown in FIG. 5. As shown in FIG. 1, junction 23 is coincident with geometric plane v and is intermediate the corresponding surfaces 21*a* (of straight section 20*a*) and 21*b* (of straight section 20*b*). Straight sections 20*a* and 20*b* have the same length and adjoin so that upper ends $\mathbf{13}a_1$ and $\mathbf{13}b_1$ are even with each other, thus affording a continuous or substantially continuous upper edge face 25 that is suitable for contacting an object moving relative to inventive device 100.

The "violin" shape of the inventive device 100 illustrated in FIG. 1 through FIG. 5 is but one of diverse shapes that are possible for practicing the present invention. As exemplified by the shown elements 12*a* and 12*b*, most inventive embodiments will be characterized by a plural number of undulations (waves) for each of two partially straight, partially undulating (wavy) elements 12, wherein the elements' corresponding undulations are equivalent and opposite. Each undulation roughly describes a "U"-shape having its closed, bent end distanced from vertical geometric plane v and its open end proximate vertical geometric plane v. The undulating profile shown in FIG. 1 reveals two undulations, each having (at the closed, bent end of its "U"-shape) a crest 35, wherein a trough 37 is situated between the crests 35. Although each element 12 is shown in FIG. 1 to describe two undulations having congruently or approximately congruently curved shapes in terms of wavelength (measured, e.g., as the longitudinal distance between trough 37 and an end 13) and amplitude (measured, e.g., as the perpendicular distance between plane v and crest 35), such congruency between or among the undulations of each element 12 is not a requirement for inventive practice.

Each element 12 includes an electrically conductive core 14 and an electrically nonconductive covering or coating 16. In each element 12, the core 14 represents the main "structural" portion of element 12. According to usual inventive practice, core 14 is composed of copper or silver or gold or another electrically conductive metal, or is composed of a metal alloy that includes copper and/or silver and/or gold and/or one or more other electrically conductive metals. Also according to usual inventive practice, covering 16 is composed of a natural rubber, or synthetic rubber (e.g., a silicone rubber), or other elastomer. Element 12*a* includes metal core 14*a* and elastomeric covering 16*a*, and element 12*b* includes metal core 14*b* and elastomeric covering 16*b*. To elaborate, in each element 12 the straight section 20 includes a portion of core 14 but excludes or substantially excludes elastomeric material; that is, the portion of core 14 that is in each straight section 20 is uncovered or substantially uncovered with elastomeric material 16. The core 14 portion of each straight section 20 is thus exposed (or substantially exposed) to permit direct moving contact, frictional to some degree, with a machine part during operation of machinery with which inventive device 100 is associated. Further, in each element 12, the sinuous section 30 includes a portion of core 14 and also includes elastomeric material 16; that is, a significant portion of core 14 that is in each sinuous section 30 is covered with elastomeric material 16. FIG. 1 represents a longitudinal section of inventive device 100 because the elastomeric material 16 covers not only the outwardly and inwardly facing surfaces, but also the edges 27, of sinuous sections 30.

Each sinuous section 30 includes a solder material-infused portion 70 and a cement material-infused portion 80. Solder-infused portion 70 is bounded on one end by vertical geometric plane v (where lower ends $13a_2$ and $13b_2$ meet) and on the other end by cement-infused portion 80. In the solder-infused portions 70*a* and 70*b*, the corresponding portions of metal cores 14*a* and 14*b* are both impregnated with a solder material 71 (which is absorbed into the metal fabric core 14 material) in order to help establish an electrical contact region 700, which is a continuum (or near-continuum) formed in part by the combined adjacency of solder-infused portions 70*a* and 70*b*. Solder-infused portions 70*a* and 70*b* combine, contiguously or nearly contiguously, to form an overall solder-infused portion of device 100, viz., overall solder-infused portion 701. Electrical contact region 700 includes not only the overall solder-infused portion 701 (which consists of the two adjacent solder-infused portions 70*a* and 70*b*), but also includes, in abutting contact with the overall solder-infused portion 701, an electrically conductive plating (e.g., electroplating) 90. In the cement-infused portions 80*a* and 80*b*, the corresponding metal cores 14*a* and 14*b* are each impregnated with a cement material 81 (which is absorbed into the metal fabric core 14 material) in order to establish a barrier for preventing solder wicking into areas of inventive device 100 other than electrical contact region 700. Each sinuous section 30 is covered with elastomeric material 16, with the exception of the outward (downward) facing surface of solder-infused portion 70. The bottom surface of electrical contact region 700 is provided not by an elastomeric material 16 but rather by the exposed electrically conductive plating 90, which serves to improve the efficiency of the electrical contact and to prevent corrosion.

Figure 6:
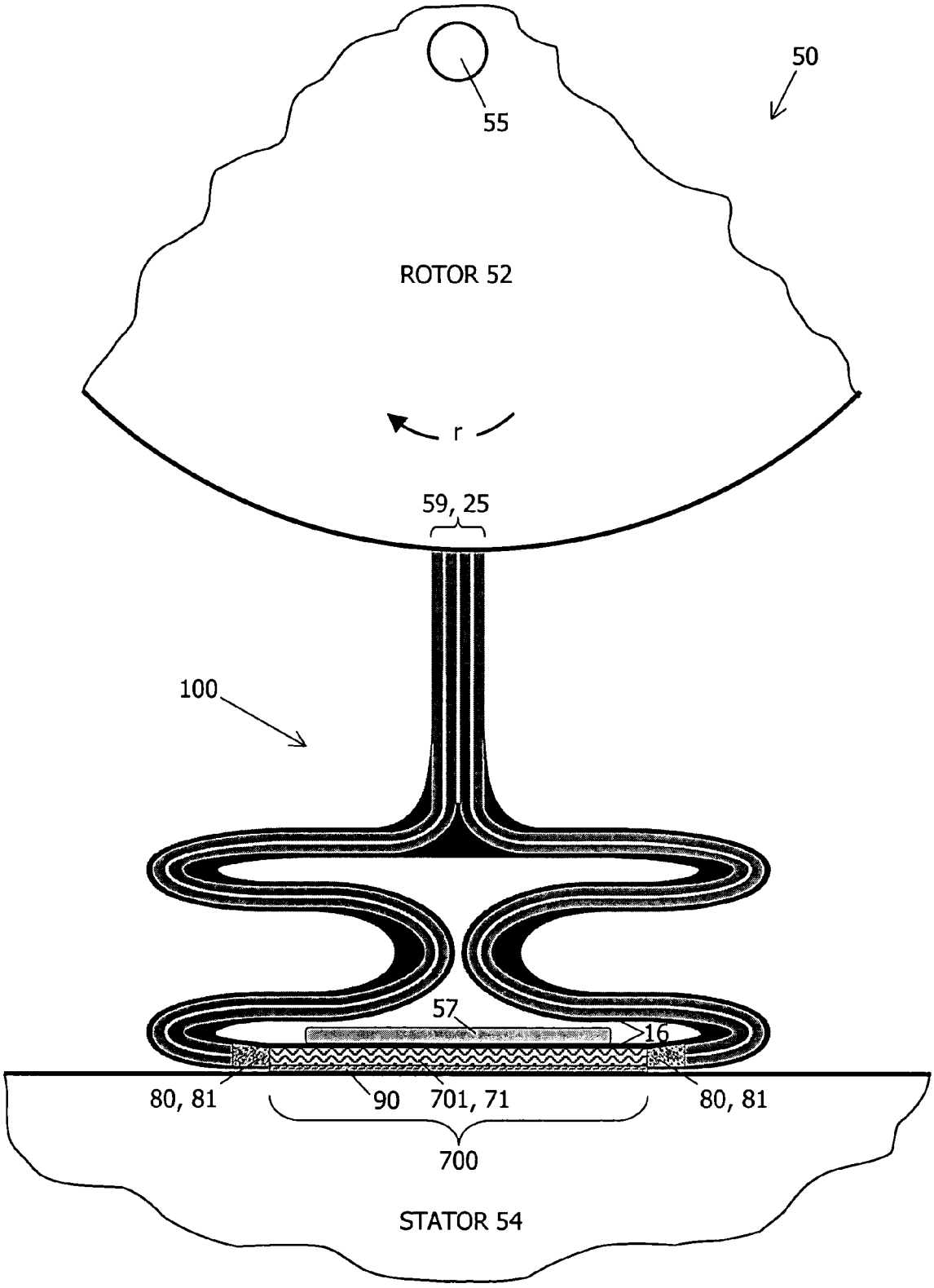
FIG. 6 and FIG. 7 are each a view, similar to the view shown in FIG. 1, illustrating use of the inventive device shown in FIG. 1 in machinery in association with machine parts including a rotor and a stator.
Figure 7:
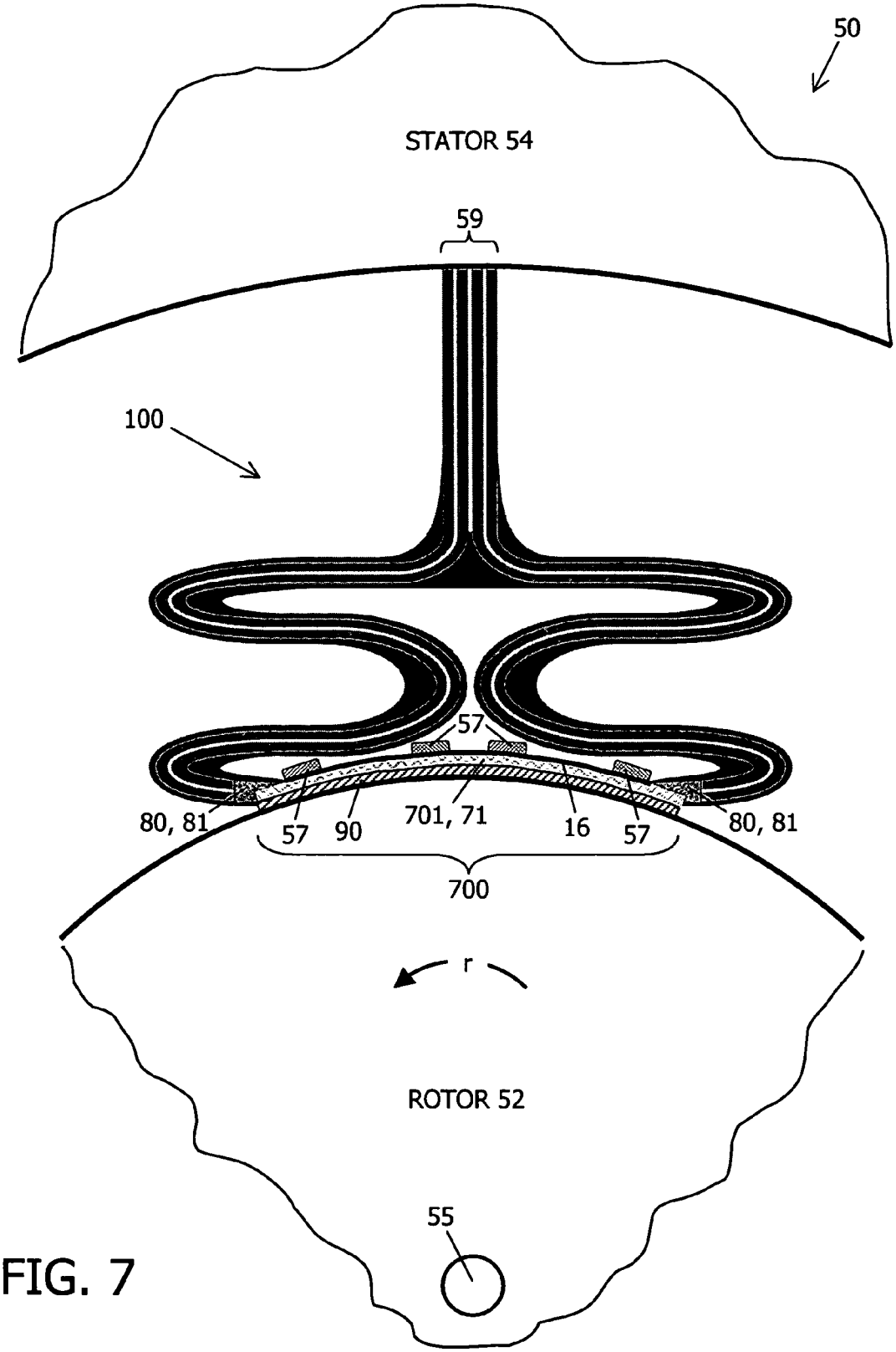

Still referring to FIG. 1 through FIG. 5, and also referring to FIG. 6 and FIG. 7, inventive device 100 can be considered to be divided into two structurally and functionally different components, viz., "brush" component 200 (the upper component as shown in FIG. 1) and "spring" component 300 (the lower component as shown in FIG. 1), which together form an integral whole, viz., inventive device 100. Imaginary horizontal geometric plane h is drawn in FIG. 1 as an approximate demarcation between brush component 200 and spring component 300. The spring component 300 shown in FIG. 1 bears some similarity, both structurally and functionally, to the "serpentine-shaped spring device" disclosed by William A. Lynch and Neal A. Sondergaard (the present inventors), et al., at U.S. Pat. No. 6,628,036 B1, issued 30 Sep. 2003, entitled "Electrical Current Transferring and Brush Pressure Exerting Spring Device," said patent incorporated herein by reference.

Brush component 200 includes straight sections 20*a* and 20*b*, which are connected to each other in abutting fashion. Spring component 300 includes sinuous sections 30*a* and 30*b*, which are connected to each other end-to-end at respective lower ends $13a_2$ and $13b_2$. Elements 12*a* and 12*b* together constitute a dual function unit 100 wherein the connected straight sections 20*a* and 20*b* together constitute a brush component 200 for making sliding, frictional contact (at upper ends $13a_1$ and $13b_1$) with a machine part that moves relative to inventive device 100, and wherein the connected sinuous sections 30*a* and 30*b* together constitute a spring component 300 for biasing brush component 200 toward the machine part that is contacted by brush component 200.

Brush component 200 includes a flat or substantially flat upper edge surface, viz., brush face 25, which is formed by the combination of the corresponding upper edge surfaces of elements 12*a* and 12*b* at upper ends $13a_1$ and $13b_1$. Brush face 25 represents the area of brush component 200 that makes contact with the moving part of a machine such as the "machinery" 50 shown in FIG. 6 and FIG. 7. Brush face 25 is characterized by an "aspect ratio," defined herein in relation to FIG. 5 as W/T, i.e., the ratio of the width W of brush face 25 to the thickness T of brush face 25. The inventive practitioner may wish to change the aspect ratio of brush face 25 in order to suit particular applications; in this regard, the width W and/or the thickness T of brush face 25 can be varied, for instance in terms of numbers, thicknesses, and/or widths of electrically conductive sheets 40.

The brush component 200 illustrated in FIG. 5, which has four electrical conduction sub-layers (sheets) 40, is rather narrow (i.e., has a relatively high aspect ratio) and should therefore afford very low magnetic circulating current losses. On the other hand, because the wires 41 (such as wires 41 shown in FIG. 9 through FIG. 11) of a typical inventive device 100 are less independent than are the electrically conductive fibers in a conventional fiber brush, inventive practice may be susceptible to higher electrical conduction losses in wires 41 as well as in interface 59. Performance characteristics (such as power loss and wear rate) may need to be tested for given inventive devices 100 in order to establish their efficacy for given applications.

In FIG. 6, inventive device 100 is mounted upon stator 54, and stationary brush component 200 contacts rotor 52 at interface 59; in FIG. 7, inventive device 100 is mounted upon rotor 52, and rotating brush component 200 contacts stator 54 at interface 59. In either arrangement, interface 59 is a surface portion that is constantly moving in accordance with the rotation of rotor 52, which rotates in a rotational direction r about a rotational axis (such as rotational axis 55 shown in FIG. 6). Electrical contact region 700 represents an electrical contact area between inventive device 100 and the machine part with which inventive device 100 is fixedly coupled. The metal plate (e.g., plating) 90 of the inventive device 100's electrical contact region 700 is in direct, fixed, physical contact with a surface region of the machine part with which inventive device 100 is fixedly coupled. According to some inventive embodiments, the machine part's fixedly contacted surface region (corresponding to electrical contact region 700) includes metal (e.g., gold or silver) plating, which abuts the inventive device 100's metal (e.g., gold or silver) plate 90. Such a plate-on-plate configuration may be particularly efficacious in terms of electrical contact efficiency and corrosion prevention.

Inventive device 100 is shown to be mechanically secured (to stator 54 in FIG. 6; to rotor 52 in FIG. 7) via one or more leaf springs 57. A "leaf spring" is but one type of diverse mechanisms that can be used in inventive practice for mounting, clamping, or otherwise attaching or affixing the inventive device 100 with respect to the electrically conductive object (stator 54 in FIG. 6; rotor 52 in FIG. 7) that is to be fixedly joined with inventive device 100. A typical leaf spring 57 is essentially a flat, rigid structure (made, e.g., of stainless steel or other material, which need not be electrically conductive) that in its natural state is moderately curved upward at its ends, which are not shown in FIG. 6 and FIG. 7. At least one leaf spring 57 can be used for clamping an inventive device 100 to an object. The leaf spring 57 is positioned, concave upward, so as to adjoin the portion of the elastomeric layer 16 that is located on the upper side of the electrical contact region 700. While the inventive device 100 is in place relative to the object, the two ends of the leaf spring 57 are pushed or bent downward (toward the object), thereby facilitating attachment at the two ends of the leaf spring 57 to the object. This attachment to the object at the two ends of the leaf spring 57 results in the application of firm, constant pressure by the leaf spring 57 onto the electrical contact region 700 and in the direction of the object, the electrical communication thereby being constantly maintained. For some embodiments, it may be preferable to provide plastic coating or tape on all or part of leaf spring 57 in order to protect the electrically conductive core material 14 and/or the elastomeric material 16 of the inventive device 100 from one or more sharp edges of the leaf spring 57. Such coating or tape on leaf spring 57 may also serve to prevent any possible corrosion that may result from interaction of the core 14's metal material with the leaf spring 57's dissimilar metal material. In inventive embodiments in which structurally discrete elements are combined in the fabrication process, the solder material 71 (which infuses the fabric core 14 material of the electrical contact region 700) may serve to both mechanically and electrically connect electrically conductive core 14*a* (at its lower end 13$a_2$) and electrically conductive core 14*b* (at its lower end 13$b_2$) to each other, in addition to participating in the electrical connection with respect to the electrically conductive object (stator 54 in FIG. 6; rotor 52 in FIG. 7) that is fixedly joined with inventive device 100. According to some inventive embodiments, the electric contact region 700 of inventive device 100 is press-fit into a complementary opening provided in the electrically conductive object to which inventive device 100 is fixedly joined.

Each sinuous section 30, in the portion thereof other than the solder-infused portion 70 and the cement-infused portion 80, represents a laminar material system that includes (i) an electrically conductive core layer 14 of uniform or approximately uniform thickness and (ii) two electrically nonconductive (e.g., elastomeric) exterior layers 16 of varying thicknesses. Each solder-infused portion 70 represents a laminar material system that includes elastomeric layer 16 on the upper side, a portion (e.g., half) of metal plate 90 on the lower side, and core layer 14 sandwiched therebetween. Electrical contact region 700 thus represents an overall laminar material system that combines the two laminar material systems corresponding to the two solder-infused portions 70, wherein elastomeric material 16 is on the upper side, metal plate 90 is on the lower side, and solder-infused core material 14 is sandwiched therebetween. According to typical inventive practice, the metal plate (e.g., plating) 90 in electrical contact region 700 is at least substantially coextensive with the combined extent of the two end-to-end adjacent solder-infused portions 70. The elastomeric layers 16 serve not only to protect much of inventive device 100's core layers 14 from the elements, but also to enhance the spring-like attributes of inventive device 100's spring component 300. The core layers 14 are strategically covered with a thicker coating of elastomeric material 16 at individual bend locations 17 and joint bend location 19 (between elements 12*a* and 12*b* and directly below interface 23), these being locations where the maximum stresses occur when spring element 300 is compressed (and thereby rendered longitudinally shorter) during use of inventive device 100, such as illustrated in FIG. 6 and FIG. 7 in the context of operating machinery 50. Thickening of elastomeric material 16 at bend locations 17 and 19 can serve not only to structurally reinforce inventive device 100 but also to enhance the resilient quality of spring component 200.

As illustrated in FIG. 6 and FIG. 7, inventive device 100 is incorporated into machinery 50, which additionally includes an electrically conductive rotor 52 (a rotating part of machinery 50) and an electrically conductive stator 54 (a stationary part of machinery 50). Inventive device 100, as shown in FIG. 6 and FIG. 7, is somewhat shorter and squatter than the same inventive device 100 is as shown in FIG. 1. Inventive device 100 is shown in FIG. 6 and FIG. 7 to be situated between rotor 52 and stator 54 so that the distance along vertical geometric plane v and between interface 59 and the bottom surface of plate 90 of electrical connection region 700 is less than such distance is when inventive device 100 is freely situated as shown in FIG. 1. Inventive device 100 is thus caused to be subjected to a longitudinal compressive force or stress that results in a shortening of length $L_{SIN}$ of spring component 300 and therefore a shortening of the overall length L of inventive device 100. The bias-exerting attributes of spring component 300 are associated with this compression of spring component 300. Spring component 300 exerts a bias (force, pressure, influence) with respect to brush component 200 so as to maintain brush component 200, on a continuous basis, in a moderate pushing or pressing disposition at interface 59 against the slidingly, frictionally contacted object (rotor 52 in FIG. 6; stator 54 in FIG. 7).

As shown in FIG. 6, inventive device 100 is attached at electrical contact region 700 to stator 54. In contrast, as shown in FIG. 7, inventive device 100 is attached at electrical contact region 700 to rotor 52. In FIG. 6 the brush component 200 of stationary inventive device 100 is in sliding contact with rotor 52 at current collection interface 59 during rotation of rotor 52, whereas in FIG. 7 the brush component 200 of moving (revolving) inventive device 100 is in sliding contact with stator 54 at current collection interface 59 during rotation of rotor 52. Inventive device 100 is shown in both FIG. 6 and FIG. 7 to be perpendicular to rotor 52; otherwise expressed, vertical geometric plane v is shown to be perpendicular to the circular outline of rotor 52. Nevertheless, brush component 200 can be disposed in either a perpendicular or oblique orientation with respect to rotor 52, depending on the inventive application.

FIG. 6 and FIG. 7 are highly diagrammatic in nature. The terms "rotor" and "stator" are broadly used herein to refer to any rotating part and any stationary part, respectively, of any of diverse electrical or electromechanical machines (e.g., direct current motor-type machine, direct current generator-type machine, commutator-type machine, etc.) suitable for inventive practice, including but not limited to homopolar motors and homopolar generators. It is to be understood, however, that the rotor-stator arrangements of FIG. 6 and FIG. 7 are shown by way of example and are not intended to suggest any limitation regarding the present invention's potential applicability. For instance, the present invention can be practiced so as to use a solitary inventive device 100 (typically for instrumentation purposes) rather than paired inventive devices 100 (typically for power purposes). According to typical powering modes of inventive practice, the inventive device 100 shown in FIG. 6 and FIG. 7 would be one of a pair of inventive devices 100. The present invention can be practiced in association with any machine having parts that move relative to each other, regardless of whether either part is characterized by rotative motion, linear motion, reciprocating motion, or any other kind of motion.

Regardless of whether machinery 50 is in the nature of a motor or a generator or another apparatus, according to typical inventive practice involving powering, inventive devices 100 are used in pairs. In each pair of inventive devices 100, one inventive device 100 carries electrical current to (or into) the rotor 52, while the other inventive device 100 carries electrical current from (or out of) the rotor 52; depending on the inventive application, either one of the pair of inventive devices 100 can be attached to either the rotor 52 or the stator 54. FIG. 6 (which shows inventive device 100 attached to stator 54) and FIG. 7 (which shows inventive device 100 attached to rotor 52) can each be conceived as portraying part of machinery 50 either of a motor variety or a generator variety or some other variety. In general, known in the art are various types of machinery (including but not limited to motor and generator types) that implement current collection means.

Inventive device 100 represents, in large part, a composite laminate material system characterized by a nonconductive (e.g., elastomeric) exterior layer, viz., elastomeric covering 16, and an electrically conductive (e.g., metal) interior layer, viz., core 14. With the exception of electrical contact region 700 (where the elastomeric exterior layer 16 is placed on the inwardly-upwardly facing surface but not the outwardly-downwardly facing surface of each element 12), the elastomeric exterior layer 16 is placed on both the inwardly facing surface and the outwardly facing surface of each element 12. According to some inventive embodiments, each core 14 includes a single sheet 40, such as shown in FIG. 8, of electrically conductive material, either a metal or metal alloy, such as consisting of or including copper, or silver, or gold or another electrically conductive metal. Although the present invention does not require that each core 14 itself have a layered construction, in furtherance of the strength and flexibility of the spring component 300, many inventive embodiments provide for a plural-layered core 14, each sub-layer of core 14 being constituted by an individual sheet 40 such as shown in FIG. 8. According to typical inventive practice involving plural-layered cores 14, the adjacent (abutting) sub-layers (sheets) 40 of a plural-layered core 14 are adhered to each other, surface-to-surface, using a cement or other adhesive material. The electrically conductive compositions of the respective sub-layer sheets 40 can be the same or can differ, depending on the inventive embodiment, the electrically conductive material of each sub-layer sheet 40 being either a metal or metal alloy, such as consisting of or including copper, or silver, or gold or another electrically conductive metal. The sheet sub-layers 40 are not necessarily adhered to each other throughout inventive device 100, over entire expanses of surface-to-surface contact areas between adjacent sheets 40 of inventive device 100. The amounts, scopes and locations of adhesive material 29 can differ, depending on the inventive embodiment. Generally speaking, the more adhesive 29 used, the greater the stiffness of inventive device 100. For instance, adhesive material 29 can be used over all or substantially all of the surface-to-surface contact areas, if greater stiffness in inventive device 100 is desired. Alternatively, adhesive material 29 can be applied selectively in certain strategically located portions of the surface-to-surface contact areas (e.g., including at one or more points along junction 23 in brush component 200).

As illustrated in FIG. 1 and FIG. 5 through FIG. 7, each core 14 has a plural-layered configuration formed, at least, by two rectangular sheets 40 of electrically conductive material (such as copper or another electrically conductive metal). As discussed hereinabove, adhesive 29 is typically applied, to some extent(s), in order to bond adjacent sheets 40. Therefore, where adhesive material 29 is present, the plural-layered configuration of core 14 is formed by two adjacent sheets 40 and adhesive material 29 situated between the two sheets 40. Where adhesive material 29 is absent, the plural-layered configuration of core 14 is formed by two adjacent sheets 40, touching or nearly touching each other, with no adhesive 29 therebetween. Inventive device 100 is readily envisioned in FIG. 1 and FIG. 5 through FIG. 7 to include or exclude adhesive 29 in any arrangement or pattern. Let us assume, for instance, that adhesive 29 is used throughout or substantially throughout inventive device 100. Core 14*a* includes two adjoining electrically conductive sheets $\mathbf{40}a_1$ and $\mathbf{40}a_2$ and adhesive material 29*a* therebetween; core 14*b* includes two adjoining electrically conductive sheets $\mathbf{40}b_1$ and $\mathbf{40}b_2$ and adhesive material 29*b* therebetween. Brush component 200 describes a laminar material system of four electrically conductive sheet layers 40 and three adhesive material layers 29 in alternation with each other. The four electrically conductive sheet layers 40 (viz., $\mathbf{40}a_1$, $\mathbf{40}a_2$, $\mathbf{40}b_2$, $\mathbf{40}b_1$) are separated by the three adhesive layers 29 (viz., 29*a*, 29*c*, 29*b*). That is, proceeding sequentially downward in FIG. 5, the adjacent layers of brush component 200 are $\mathbf{40}a_1$, 29*a*, $\mathbf{40}a_2$, 29*c*, $\mathbf{40}b_2$, 29*b*, and $\mathbf{40}b_1$. Layers $\mathbf{40}a_1$, 29*a*, and $\mathbf{40}a_2$ are sub-layers of electrically conductive core 14*a*; layers $\mathbf{40}b_1$, 29*b*, and $\mathbf{40}b_2$ are sub-layers of electrically conductive core 14*b*.

Regardless of whether cores 14 are layered (i.e., including at least two sheets 40) or unlayered (i.e., including one sheet 40), according to frequent inventive practice, each sheet 40 is an electrically conductive fabric member such as a "braided" electrically conductive fabric member, wherein the fabric member's "braided" configuration of electrically conductive wires lends desirable material qualities in terms of strength and flexibility for purposes of being made part of an integral current collection device 100 in accordance with the present invention. According to typical inventive practice, the electrically conductive wires are made of at least one electrically conductive metal that is selected from the group of electrically conductive metals including, but not limited to, copper, silver, and gold; alternatively, the electrically conductive wires are made of at least one electrically conductive metal alloy that alloys at least one electrically conductive metal that is selected from the group of electrically conductive metals including, but not limited to, copper, silver, and gold. The term "electrically conductive wire fabric" is broadly used herein to refer to any generally planar electrically conductive structure characterized by interlacing, intertwining, interweaving and/or binding of plural (e.g., multiple) electrical wires. An electrically conductive wire fabric can represent any of diverse combinations (e.g., woven, knitted, braided, meshed, knotted, felted and/or bonded) of electrically conductive wires oriented in two and/or three dimensions. The term "electrically conductive wire" is broadly used herein to refer to any elongate electrically conductive member (e.g., made of electrically conductive metal material). An electrically conductive wire can represent a single electrically conductive strand, fiber or filament, or a combination (e.g., bundled, twisted, braided) of electrically conductive strands, fibers or filaments.

FIG. 8 is diagrammatically representative of an electrically conductive sheet 40, one or more of which constitutes a core 14. In accordance with inventive practice, a sheet 40 need not be fabric. For instance, some inventive embodiments provide for a core 14 comprising at least one electrically conductive metal foil sheet 40. Nevertheless, according to typical inventive embodiments, each sheet 40 is a piece of fabric, which is characterized by interlacing, intertwining, interweaving and/or binding of electrical wires. For instance, a fabric sheet 40 can exhibit a biaxially braided fabric pattern of wires 41 such as shown in FIG. 9, or a triaxially braided fabric pattern of wires 41 such as shown in FIG. 10, or a multi-braid pattern of parallelly bonded "braids" 43. Each braid 43 is a strand, string, cord, etc. that is configured of wires 41 that are braided into such elongate form.

Elongate wire braids 43 such as shown in FIG. 11, which are akin to the elongate hair braids adopted by some people in their hair style, are commercially available in the form of elongate items known as "solder wicks" (or "desolder wicks") or "solder braids" (or "desolder braids"). A typical solder wick is manufactured as a metal (e.g., copper) structure coated with a flux such as a rosin material. A fabric sheet 40 can be assembled of individual wire braids 43 from commercial off-the-shelf (COTS) materials. A spindle of (e.g., 0.075 inch) solder wick can be obtained from any of various commercial entities (e.g., Radio Shack™). The solder wick is cut into strips (e.g., 7-inch strips). The solder wick strips are placed in acetone for being cleaned and are then removed from the acetone. The solder wick strips 43 are placed, even, parallel and contiguous, in the slot of a braided fabric fabrication plate (e.g., a 6-inch by 3.5-inch by 0.5-inch thick piece of aluminum having a ¾-inch wide, 1/16-inch deep slot across it for braided fabric assembly), and are secured (e.g., screwed down) at each end of each strip. An adhesive (e.g., Permatex™ automotive gasket cement thinned 50%) is applied to the adjoining solder wicks 43 inside the slot of the braid fabrication plate, and allowed to dry (e.g., about a half hour). The adjoining solder wicks 43 are removed and replaced in an inverted position in the slot of the fabrication plate. The adhesive is again applied to the adjoining solder wicks 43 and allowed to dry in a similar manner, whereupon the completed braided fabric 40 product is removed from the fabrication plate.

Figure 12:
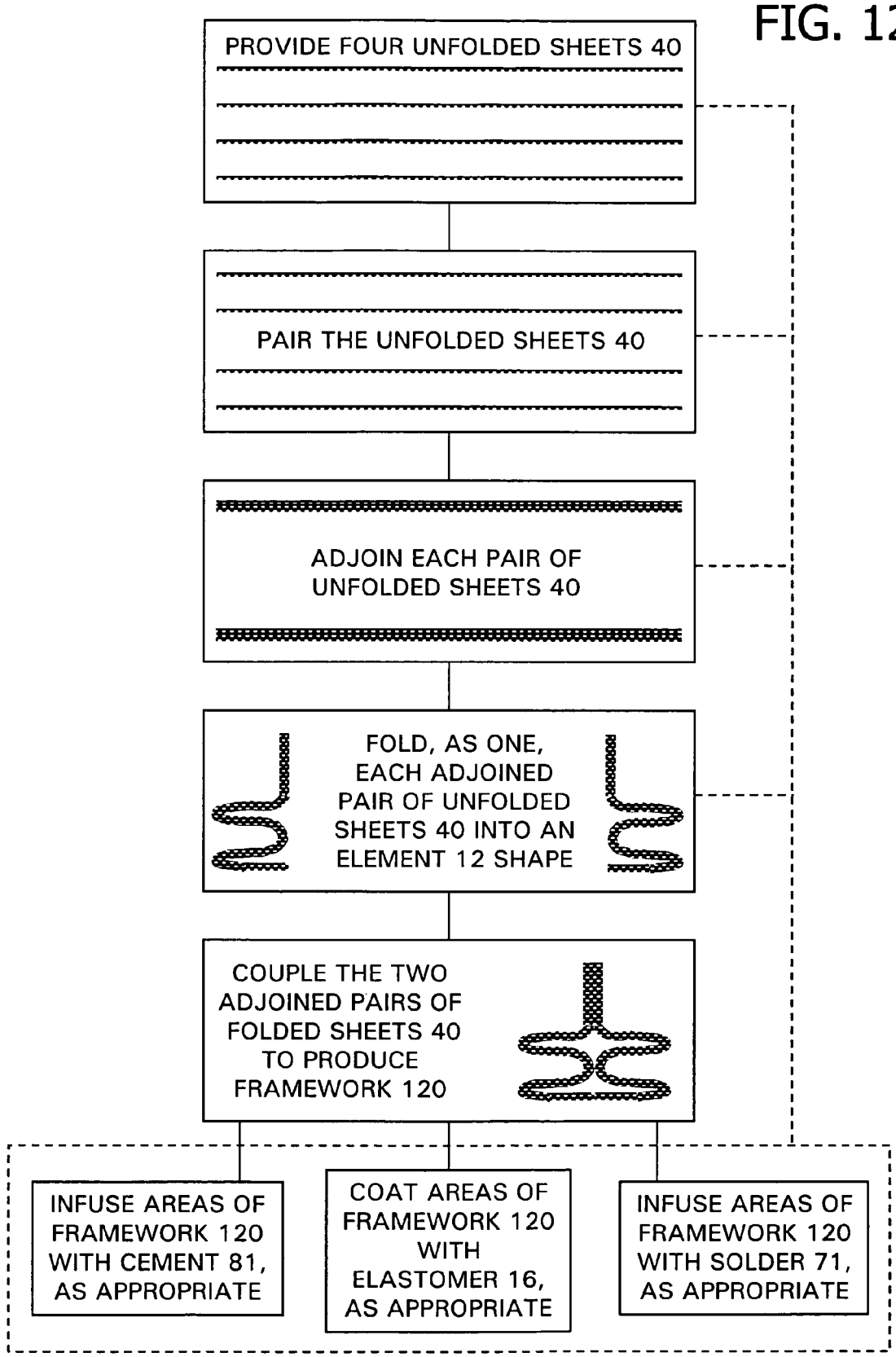
FIG. 12, FIG. 13, FIG. 14 and FIG. 15 are each a schematic of an embodiment of an inventive method for fabricating an inventive device.
Figure 13:
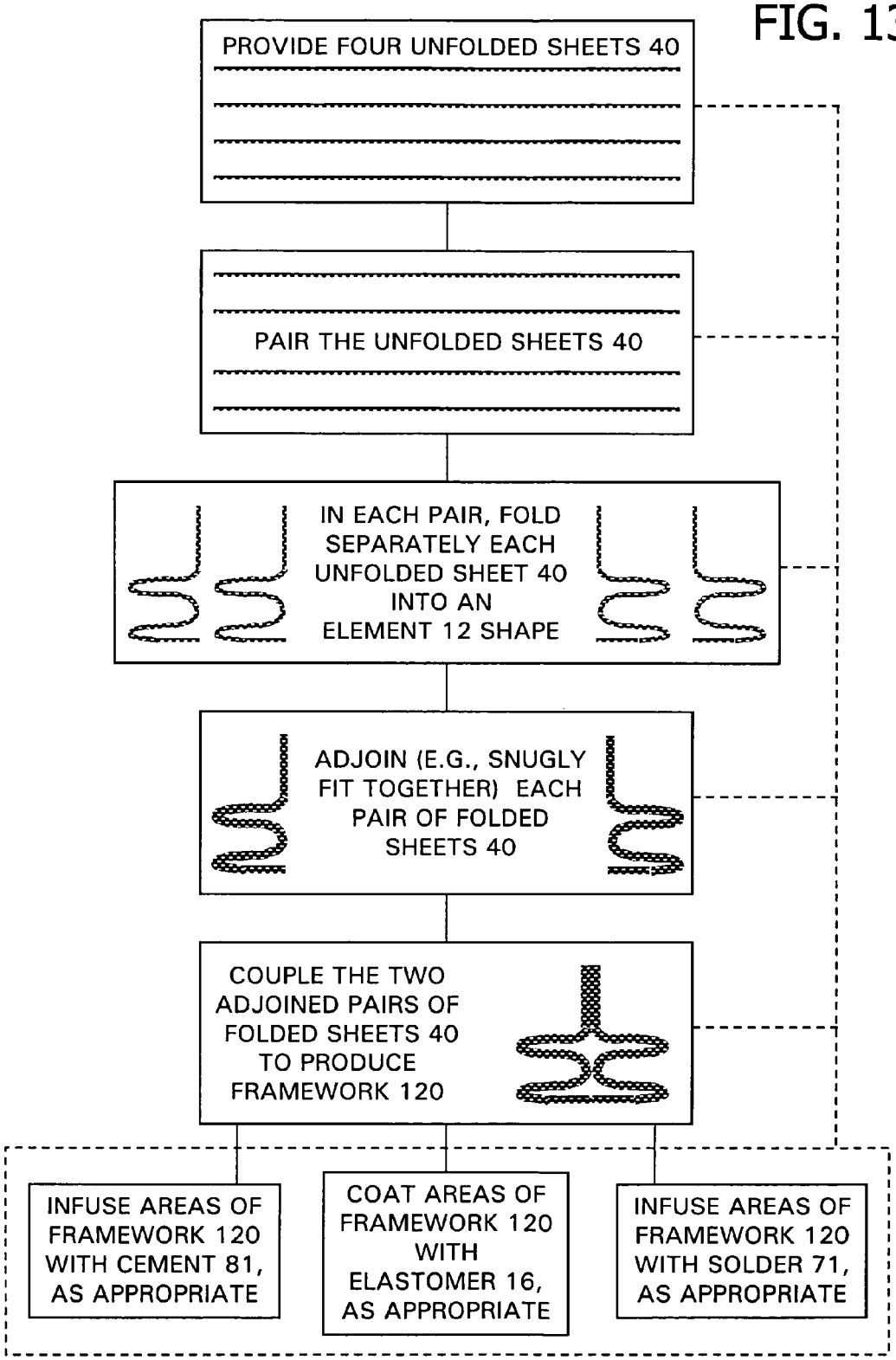
Figure 14:
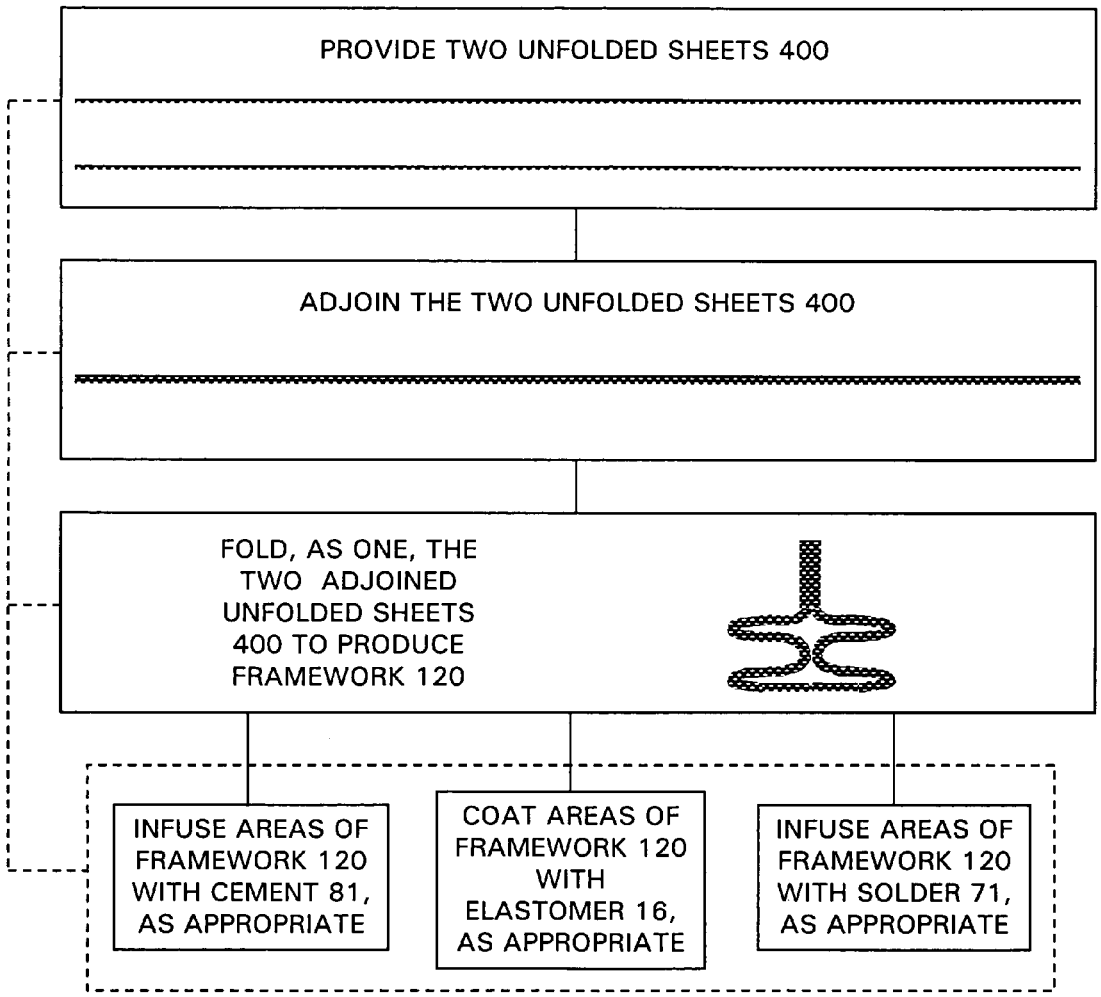
Figure 15:
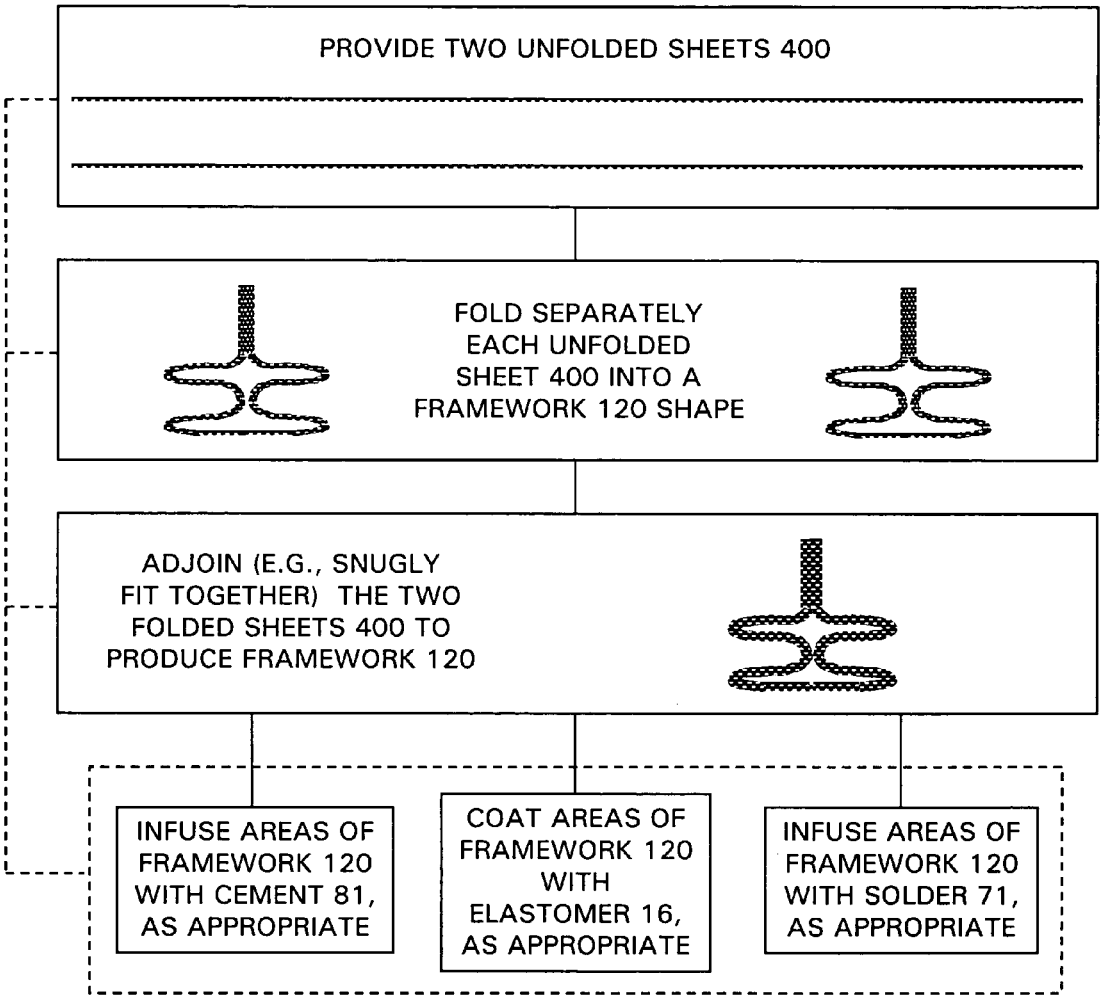

In the light of the instant disclosure, various methods and techniques for fabricating an inventive device such as shown in FIG. 1 through FIG. 7 will be appreciated by the ordinarily skilled artisan. The present invention lends itself to economical fabrication using relatively inexpensive commercial off-the-shelf (COTS) materials, as suitable, such as metal fabrics, solder braids, and silicone rubber from automotive gaskets. With reference to FIG. 12 through FIG. 15, many embodiments for making an inventive device such as inventive device 100 provide initially for the assembly of electrically conductive core 12 material into an electrically conductive core framework 120 that essentially describes the "violin" shape of inventive device 100. FIG. 12 and FIG. 13 illustrate an inventive methodology that takes a bilateral (with respect to vertical geometric plane v), dichotomized approach to fabrication, according to which each of the elements 12*a* and 12*b* is separately formed from one or more sheets 40 (including appropriately bent into sinuous shape), and the elements 12*a* and 12*b* are then joined together to form framework 120. FIG. 14 and FIG. 15 illustrate an alternative, often preferred, inventive methodology that takes a more entire approach to fabrication, according to which one or more sufficiently long wire fabric sheets 400 are bent into a violin shape so as to extend therearound from upper end $\mathbf{13}a_1$ to upper end $\mathbf{13}a_2$, thereby integrally forming framework 120.

According to an example of a first inventive approach to making an inventive device, the inventive practitioner provides four planar (unbent) rectangular sheets 40, practically identical, of electrically conductive wire fabric. The four wire fabric sheets 40 are separated into two pairs, each pair corresponding to an element 12. For instance, as shown in FIG. 1 and FIG. 5, sheets $\mathbf{40}a_1$ and $\mathbf{40}a_2$ are paired in element 12*a*; sheets $\mathbf{40}b_1$ and $\mathbf{40}b_2$ are paired in element 12*b*. The two wire fabric sheets 40 in each pair are fixedly adjoined to each other using an adhesive material such as a cement material. According to some inventive embodiments, in addition to or as alternative to adhesive material 29, cross-stitching is implemented with respect to the two adjoined sheets 40 in each pair in order to strengthen the inventive device and afford it a more stable shape. As depicted in FIG. 12, each of the two adjoined pairs of wire fabric sheets 40 is bent together into an element 12 shape, characterized in part by linearity and in part by sinuosity, the two adjoined pairs being bent into practically identical partially linear, partially sinuous shapes. An alternative technique, depicted in FIG. 13, is to bend each sheet 40 into an element 12 shape prior to adjoining two sheets 40, the pairing being performed so as to nestle one bent sheet 40 inside the other; this technique may pose some degree of practical difficulty, however, as it would generally necessitate that the interior bent sheet 40 describe a slightly or moderately smaller element 12 shape than is described by the exterior bent sheet 40. The two bent, adjoined pairs of wire fabric sheets 40, each pair representing an element 12, are coupled in opposition to each other, with the corresponding linear sections 20*a* and 20*b* of the two pairs being fixedly adjoined to each other using an adhesive material such as a cement material, and with the two lower element ends $\mathbf{13}a_2$ and $\mathbf{13}b_2$ adjoining each other (e.g., touching or nearly touching) end-to-end, thereby forming the violin-shaped electroconductive framework 120. A lower portion 701 of device 100 (wherein portion 701 encompasses the junction between ends $\mathbf{13}a_2$ and $\mathbf{13}b_2$) is impregnated with the liquid solder material, which solidifies. The solder-infused portion 701 is then heated to re-melt the solder material (which is then allowed to re-solidify), thereby facilitating bonding between wire fabric sheets 40 and between ends $\mathbf{13}a_2$ and $\mathbf{13}b_2$. Finally, the re-solidified solder-infused portion 701 is pressed to form a flat contact for attachment to the machinery.

According to an example of a second inventive approach to making an inventive device, the inventive practitioner provides two planar (unbent) rectangular sheets 400, practically identical, of electrically conductive wire fabric. Each sheet 400 is present, in approximately fifty—fifty proportions, in both elements 12*a* and 12*b*. For instance, as shown in FIG. 1 and FIG. 5, half of sheet 400' is on the outwardly facing side of element 12*a*, and half of sheet 400' is on the outwardly facing side of element 12*b*; half of sheet 400" is on the inwardly facing side of element 12*a*, and half of sheet 400" is on the inwardly facing side of element 12*b*. The two wire fabric sheets 400 are fixedly adjoined to each other using an adhesive material such as a cement material. According to some inventive embodiments, in addition to or as alternative to adhesive material 29, cross-stitching is implemented with respect to the two adjoined sheets 400 in order to strengthen the inventive device and afford it a more stable shape. As depicted in FIG. 14, the two adjoined wire fabric sheets 400 are bent together into the electrically conductive violin-shaped framework 120, with the corresponding linear sections 20*a* and 20*b* of the two elements 12*a* and 12*b* being fixedly adjoined to each other using an adhesive material such as a cement material. An alternative technique, depicted in FIG. 15, is to bend each sheet 400 into framework 120 violin shape prior to adjoining the two sheets 400, one bent sheet 400 being nestled inside the other; again, this technique may pose some degree of practical difficulty, as it would generally necessitate that the interior bent sheet 400 describe a slightly or moderately smaller framework 120 shape than is described by the exterior bent sheet 400.

Once the violin-shaped electroconductive framework 120 is provided, the following steps are performed, in no particular order, at suitable locations and to suitable degrees: Inside and outside surfaces of framework 120 are covered with elastomeric material 16; two discrete portions of framework 120 are infused with cement material 81 (which is absorbed into the wire fabric 40 or 400 material), thereby forming two discrete cement-infused portions 80; an at least substantially continuous portion (extending between the two cement-infused portions 80 and encompassing the adjoining ends of elements 12) of framework 120 is infused with solder material 71 (which is absorbed into the wire fabric 40 or 400 material), thereby forming the overall solder-infused portion 701 of the inventive device; the solder-infused portion 701 is heated to re-melt the solder material 71, which then re-soldifies, such re-melting and re-solidifying of solder material 71 serving to enhance bonding between wire fabric sheets 400 (or between wire fabric sheets 40 as well as between ends 13$a_2$ and 13$b_2$); the re-solidified solder-infused portion 701 is pressed; and, an electrically conductive plating 90 is attached, typically by electroplating, at the underside of the overall solder-infused portion 701 of the inventive device, thereby forming the overall electrical contact area 700 of the inventive device.

As described herein in preceding paragraphs with reference to FIG. 12 through FIG. 15, some inventive techniques for making an inventive device 100 involve the assembly of a framework 120 prior to coating with elastomeric material 16, infiltration with cement material 81, and infiltration with solder material 71. However, a variety of these and other inventive fabrication techniques can be practiced. Depending on the method for making an inventive device 100, each of elastomeric material 16, cement material 81 and solder material 71 can be applied at practically any stage in the fabrication process. For instance, inside and outside surfaces of individual or adjoined sheets 40 or 400 can be covered with elastomeric material 16, prior to folding of individual or adjoined sheets 40 or 400. Similarly, prior to folding of individual or adjoined sheets 40 or 400, individual or adjoined sheets 40 or 400 can be infused with cement material 81 (which is absorbed into the wire fabric 40 or 400 material) and/or with solder material 71. Some or all of the elastomeric material 16, cement material 81 and/or solder material 71 can be applied to each sheet 40 or 400 prior to association with any other sheet 40 or 400. According to some inventive approaches, elastomer 16 is administered prior to the folding of sheets 40 or 400; then, additional elastomer 16 is administered at strategic locations (e.g., at individual bend locations 17 and at joint bend location 19) subsequent to the folding of sheets 40 or 400, or subsequent to the assembly of framework 120, in order to enhance the "springiness" of the spring component 300 of inventive device 100. If any elastomer 16, cement 81 and/or solder 71 is applied prior to folding sheets 40 or 400, it is important that the inventive practitioner correctly anticipate the locations of such material(s) upon assembly of device 100.

Now referring to FIG. 16, inventive braid brush 3000 represents a brush-inclusive, holder-exclusive embodiment of the present invention. Inventive braid brush 3000 corresponds to the brush component 200 of inventive embodiments such as described hereinabove with reference to FIG. 1 through FIG. 15. The inventive prototype of braid brush 3000 pictured in FIG. 16 was made using COTS solder wicks and automotive gasket silicone rubber. The portrayed brush 3000 includes eight rows of individual solder wick braids 43, an adhesive solder barrier, and a solder coating on its base. Each row of solder wicks 43 has about nine solder wicks 43 that are discretely arrayed, adjacent and edgewise. The numbers of "rows" and "columms" of solder wicks 43 can be varied in inventive practice in accordance with the desired aspect ratio.

Braid brush 3000 can be attached to a holder (e.g., the brush holder disclosed by Lynch et al. at the aforementioned U.S. Pat. No. 6,628,036 B1 issued 30 Sep. 2003, entitled "Electrical Current Transferring and Brush Pressure Exerting Spring Device") using known soldering techniques for attaching fiber brushes to holders. The combination of a braid brush 3000 with the brush holder of Lynch et al. U.S. Pat. No. 6,628,036 B1 may afford a kind of synergy associated with the commonality of a braid-based construction. Braid brush 3000 may be suitable for any application for which a conventional fiber brush may be suitable, such as involving motors (e.g., homopolar motors), generators (e.g., homopolar generators), commutators, etc.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. A device for establishing electrical connection between two objects that are moving relative to each other, said device comprising two congruous elements, at least approximately equal in length, each said element having two ends and including a longitudinally straight section bounded by the first said end and a longitudinally sinuous section bounded by the second said end, said elements being contrapositionally coupled so that said straight sections adjoin and are at least approximately even at the first said ends, and so that said sinuous sections are oppositely undulate and are at least approximately connected at the second said ends, said device being securable in the vicinity of the second said ends with respect to a first part of machinery so that said straight sections together constitute a brush for contacting a second part of said machinery.

2. The device of claim 1, said device being securable in the vicinity of the second said ends with respect to said first part of machinery so that said sinuous sections together constitute a spring for biasing said straight sections toward said second part of said machinery, said second part of said machinery moving relative to said device, said contacting occurring, to at least a substantial degree, at the first said ends.

3. The device of claim 2, wherein said device is characterized by an axial length extending between the first said ends and the second said ends, and wherein said spring constitution of said sinuous sections is associated with a reduction in said length when said device is secured in the vicinity of the second said ends with respect to said first part of said machinery.

4. The device of claim 2 wherein said device is a current collection device, each said element being electrically conductive, said first part of said machinery being a stationary part of said machinery, said second part of said machinery being a moving part of said machinery, said current collection device being securable in the vicinity of the second said ends with respect to said first part of said machinery so that said elements together constitute an electrical conductor between said moving part of said machinery and said stationary part of said machinery.

5. The device of claim 2 wherein said device is a current collection device, each said element being electrically conductive, said first part of said machinery being a moving part of said machinery, said second part of said machinery being a stationary part of said machinery, said current collection device being securable in the vicinity of the second said ends with respect to said moving part of said machinery so that said elements together constitute an electrical conductor between said stationary part of said machinery and said moving part of said machinery.

6. The device of claim 2, wherein:

each said element is electrically conductive;

each said element includes at least one electrically conductive wire fabric and an elastomeric coating;

in each said element, said at least one wire fabric extends from the first said end to the second said end;

in each said element, said elastomeric coating covers a portion of the outside surfaces of said at least one wire fabric in said sinuous section;

in each said element, a portion of said at least one wire fabric is infused with a cement material;

in each said element, a portion of said at least one wire fabric is infused with a solder material;

in each said element, said solder-infused portion extends between the second said end and said cement-infused portion;

said two solder-infused portions together form a combined solder-infused portion of said device, said combined solder-infused portion extending between said cement-infused portions;

said device further comprises an electrically conductive plate that is attached to said combined solder-infused portion;

said plate at least substantially corresponds to said vicinity of the second said ends;

said device is securable in said vicinity of the second said ends so that said device conducts electricity between said first part of said machinery and said second part of said machinery, said electricity being conducted through said elements and said plate.

7. The device of claim 2, wherein:

each said element includes an electrically conductive wire fabric and an elastomeric coating;

in each said element, said wire fabric extends from the first said end to the second said end;

in each said element, said elastomeric coating covers a portion of the outside surfaces of said wire fabric in said sinuous section;

in each said element, a portion of said wire fabric is infused with a cement material;

in each said element, a portion of said wire fabric is infused with a solder material, said solder-infused portion extending between the second said end and said cement-infused portion.

8. The device of claim 2, wherein:

each said element includes at least two adjoining electrically conductive sheets and an elastomeric coating;

in each said element, said at least two adjoining sheets extend from the first said end to the second said end;

in each element, said elastomeric coating at least substantially covers the outside surfaces of said at least two adjoining sheets in said sinuous section.

9. The device of claim 8, wherein each said sheet is an electrically conductive wire fabric.

10. A device for effecting electrical connection between two objects that are moving relative to each other, said device being capable of attachment to the first said object so as to effect sliding contact with the second said object, said device comprising a pair of elements that bend, equivalently and oppositely, at least twice outwardly and at least once inwardly with respect to a geometric plane of at least approximate symmetry therebetween, each said element including an electrically conductive core layer and two electrically nonconductive exterior layers that each partially cover said core layer, each said element including a sinuous portion and a straight portion, each said sinuous portion describing an at least substantially sinuous profile and being partially covered by said electrically nonconductive layer, each said straight portion describing an at least substantially straight profile and being at least substantially uncovered, said straight portions each having an at least substantially flat surface and together forming an abutment of said at least substantially flat surfaces that is at least approximately coincident with said geometric plane, said device being capable, while said sinuous portions are attached to the first said object and said straight portions are in sliding contact with the second said object, of conducting electrical current through said electrically conductive core layers and between the first said object and the second said object.

11. The device for effecting electrical connection as defined in claim 10, wherein each said electrically nonconductive exterior layer is composed of an elastomeric material.

12. The device for effecting electrical connection as defined in claim 10, wherein:

the combination including said straight portions represents a brush component of said device;

the combination including said sinuous portions represents a spring component of said device;

while said sinuous portions are attached to the first said object and said straight portions are in sliding contact with the second said object, said spring component is capable of exerting a bias upon said brush component toward the second said object.

13. The device for effecting electrical connection as defined in claim 10, wherein each said electrically conductive core layer includes an electrically conductive wire fabric sheet.

14. The device for effecting electrical connection as defined in claim 10, wherein each said electrically conductive core layer includes plural sub-layers, each said sub-layer including an electrically conductive wire fabric sheet.

15. The device for effecting electrical connection as defined in claim 14, wherein each said electrically conductive wire fabric sheet is composed of a metal material.

16. The device for effecting electrical connection as defined in claim 15, wherein said metal material is copper.

17. A method for establishing an electrical connection between two objects that are movable relative to each other, said objects being a first said object and a second said object, said method comprising:

providing a device including a pair of elements that bend, equivalently and oppositely, at least twice outwardly and at least once inwardly with respect to a geometric plane of at least approximate symmetry therebetween, each said element including an electrically conductive core layer and two elastomeric exterior layers that each partially cover said core layer, each said element including a sinuous portion and a straight portion, each said sinuous portion describing an at least substantially sinuous profile and being partially covered by said elastomeric layer, each said straight portion describing an at least substantially straight profile and being at least substantially uncovered, said straight portions each having an at least substantially flat surface and together forming an abutment of said at least substantially flat surfaces that is at least approximately coincident with said geometric plane; and attaching said sinuous portions to the first said object so that, during movement relative to each other of the first said object and the second said object: said straight portions are in sliding contact with the second said object; electrical current is conductible through said electrically conductive core layers and between the first said object and the second said object.

18. The method for establishing an electrical connection as defined in claim 17, wherein:

the combination including said straight portions represents a brush component of said device;

the combination including said sinuous portions represents a spring component of said device;

said attaching of said sinuous portions to the first said object is performed so that, during movement relative to each other of the first said object and the second said object, said spring component exerts a bias upon said brush component toward the second said object.

19. The method for establishing an electrical connection as defined in claim 17, wherein each said electrically conductive core layer includes an electrically conductive wire fabric sheet.

20. The method for establishing an electrical connection as defined in claim 17, wherein each said electrically conductive core layer includes plural sub-layers, each said sub-layer including an electrically conductive wire fabric sheet.

* * * * *